United States Patent [19]

Travis

[11] 4,144,995

[45] Mar. 20, 1979

[54] BOX SEPARATOR

[75] Inventor: Jack R. Travis, Lancaster, Ohio

[73] Assignee: Anchor Hocking Corporation, Lancaster, Ohio

[21] Appl. No.: 828,734

[22] Filed: Aug. 29, 1977

[51] Int. Cl.[2] ..... B65D 5/48

[52] U.S. Cl. ..... 229/15; 229/42

[58] Field of Search ..... 229/15, 42

[56] References Cited

U.S. PATENT DOCUMENTS

| | | | |
|---|---|---|---|
| 1,636,071 | 7/1927 | Pitt | 229/15 |
| 2,308,177 | 1/1943 | Jones | 229/15 |
| 2,517,767 | 8/1950 | Cody | 229/15 X |
| 2,920,808 | 1/1960 | McWhorter | 229/42 |
| 3,300,076 | 1/1967 | Wohl | 229/15 |
| 3,738,561 | 6/1973 | Nederveld | 229/15 |

FOREIGN PATENT DOCUMENTS

| | | | |
|---|---|---|---|
| 1539148 | 8/1968 | France | 229/15 |

*Primary Examiner*—Davis T. Moorhead

*Attorney, Agent, or Firm*—Holland, Armstrong, Wilkie & Previto

[57] ABSTRACT

An improved separator for cartons or boxes, such as paperboard or corrugated board boxes, is disclosed which is inserted into the boxes to provide separate compartments for the boxed articles. The separator is characterized by being formed as a single die-cut flat blank which is cut and scored or creased for being set up and inserted into the box to provide several separate compartments. The separator is particularly suited for the packaging of irregularly shaped articles with a maximum box packing density as it provides compartments having useful irregular cross-sectional shapes.

10 Claims, 9 Drawing Figures

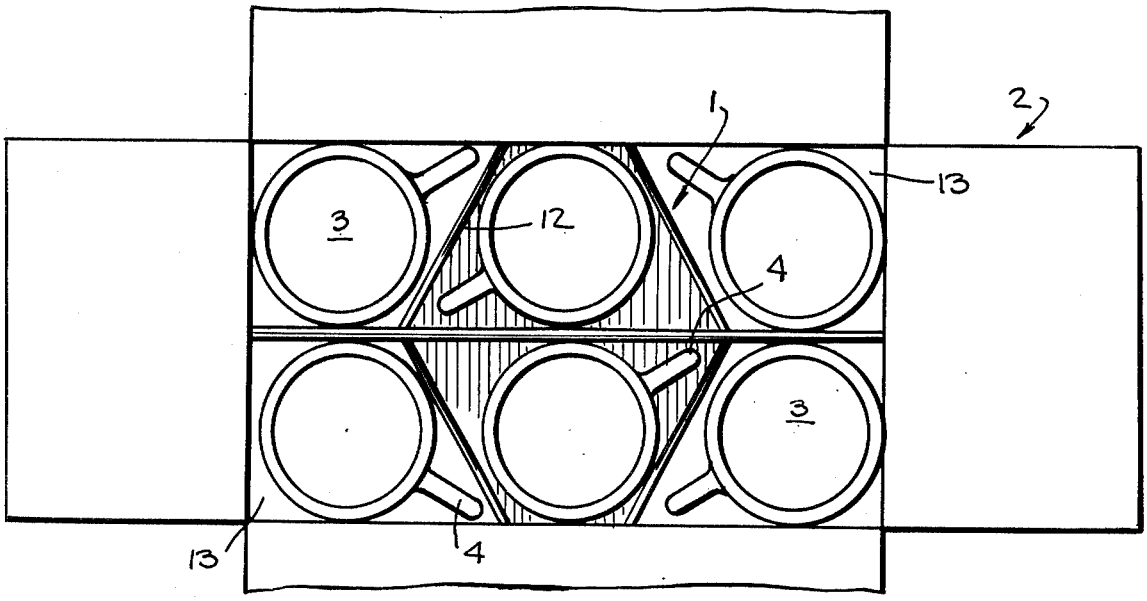
Fig. 1.
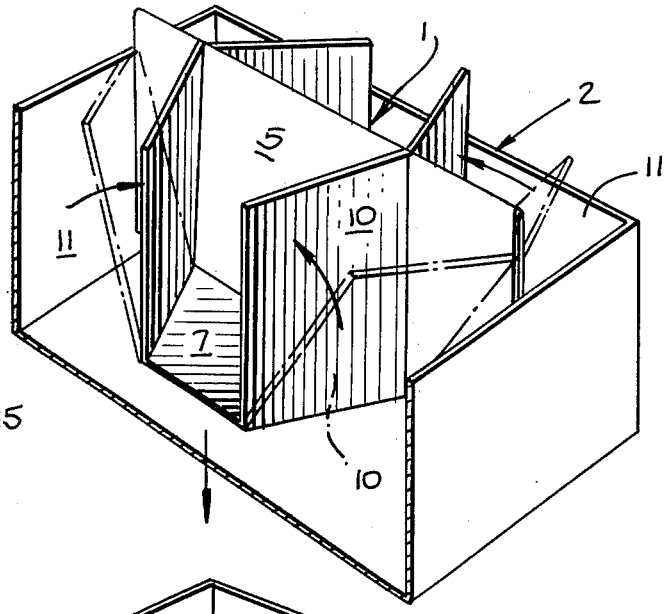
Fig. 5.
Fig. 7.
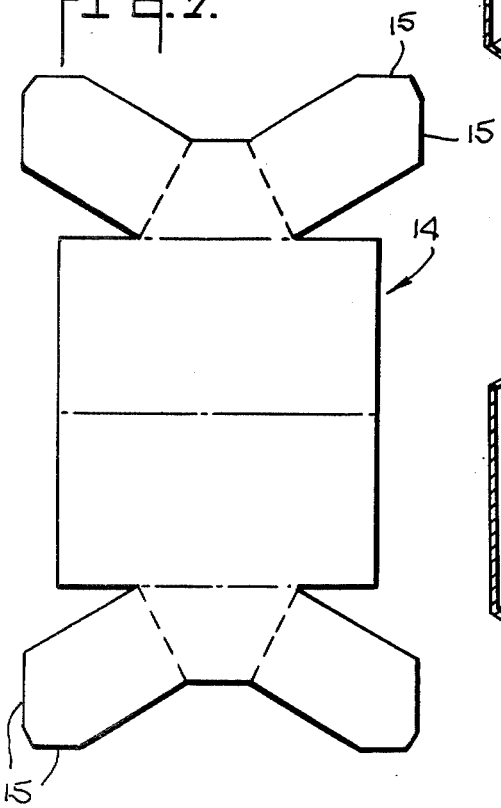
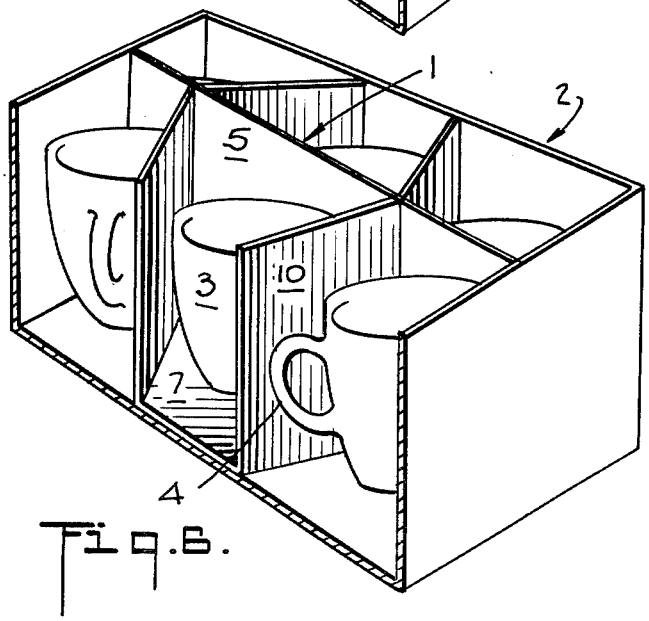
Fig. 6.

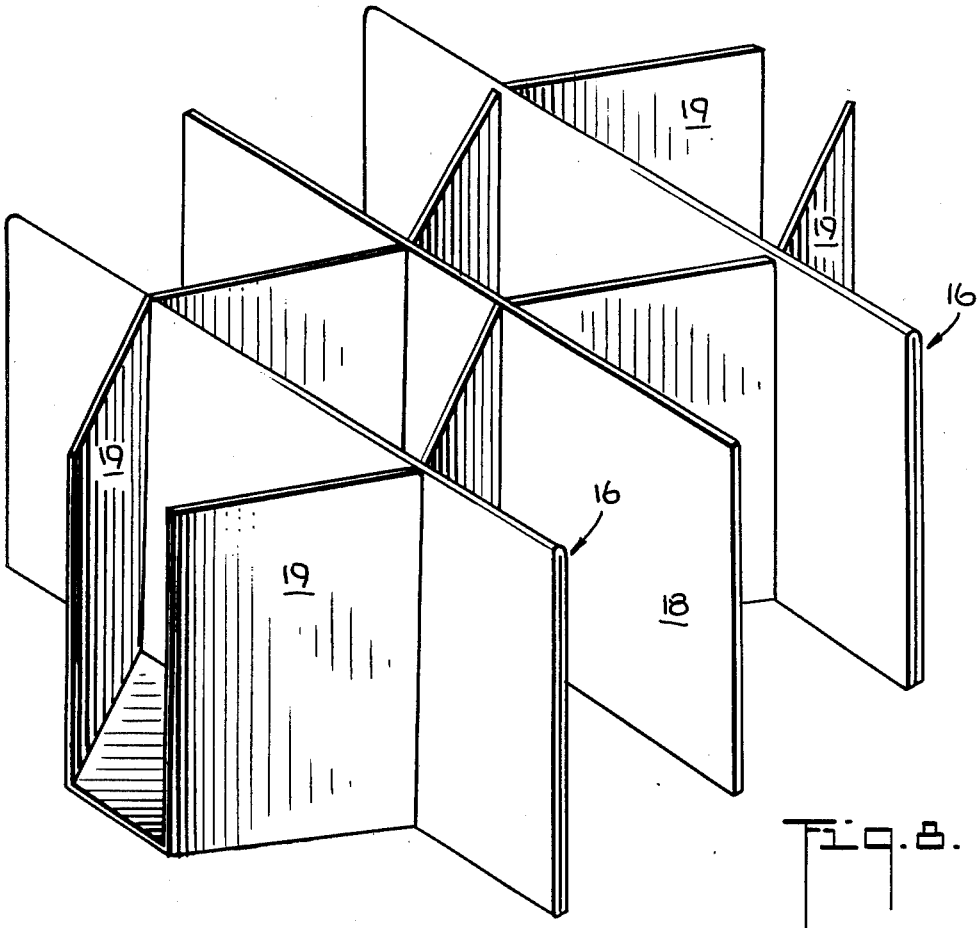
Fig. 8.
Fig. 9.
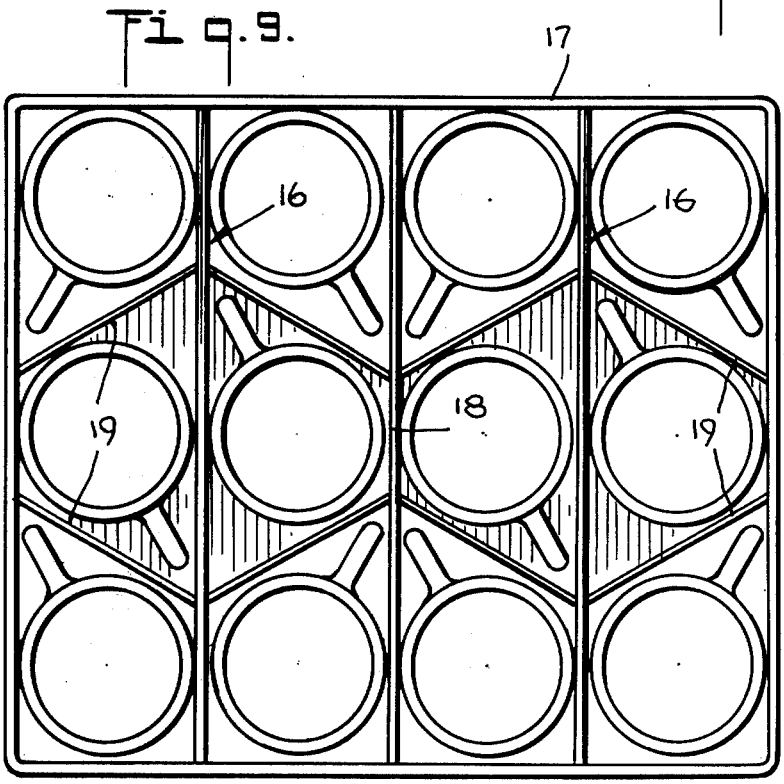

BOX SEPARATOR

BACKGROUND OF THE INVENTION

The present invention relates to packaging and more particularly to an improved and easily set-up partition for forming individual compartments in cartons or boxes.

Such partitions are now utilized routinely in paperboard or corrugated boxes to provide separate compartments for the packaged items. A well known separator in wide use, for example, is formed from a number of separate sheets cut and notched for being fitted together in the form on the separator. These present separators, including the notched designs, tend to be limited to the formation of compartments of square or generally rectangular cross-section making them inefficient for packaging irregular objects, such as, for example, cups or mugs having projecting handles. Presently used partitions or dividers for this type of irregularly shaped product utilize oversized compartments of regular cross-section where a larger size is used to accommodate the packaged item.

As will be more fully described below, the improved unitary separator of the present invention is adapted to provide compartments of irregular cross-section for the packaging of irregular articles in a box having a minimum overall volume.

The separator of the present invention is readily formed as a unitary die-cut blank so that the separator is erected by a simple folding and insertion operation.

Accordingly, an object of the present invention is to provide an improved box partition or separator.

Another object of the invention is to provide an improved separator formed as a unitary die-cut blank and which is erected by a simple folding operation.

Another object of the invention is to provide an improved box separator for efficiently packing irregularly shaped articles.

Another object of the invention is to provide an improved box separator which is of low cost and which is simple to manufacture.

Another object of the invention is to provide a separator shaped to reduce the overall carton size of cartons packaging irregular articles.

Another object of the invention is to provide an improved separator which is characterized by ease of erection and insertion into a carton.

Another object of the invention is to provide an improved separator which retains its shape and orientation after insertion into a box.

Other and further objects of the invention will be obvious upon an understanding of the illustrative embodiment about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawing, forming a part of the specification, wherein:

FIG. 1 is a top plan view of a box having a separator in accordance with the present invention.

FIG. 5 is a perspective view partially cut away illustrating the entry of the partition into the box.

FIG. 6 is a perspective view partially cut away illustrating a separator in accordance with the invention packing cups with projecting handles.

FIG. 7 is a top plan view of another embodiment of the separator blank.

FIG. 8 is a perspective view of two separators positioned for use in a larger box.

FIG. 9 is a top plan view of a box utilizing two separators in accordance with the invention.

DESCRIPTION OF THE PREFERRED EMBODIMENT

Figures 2, 3, 4:
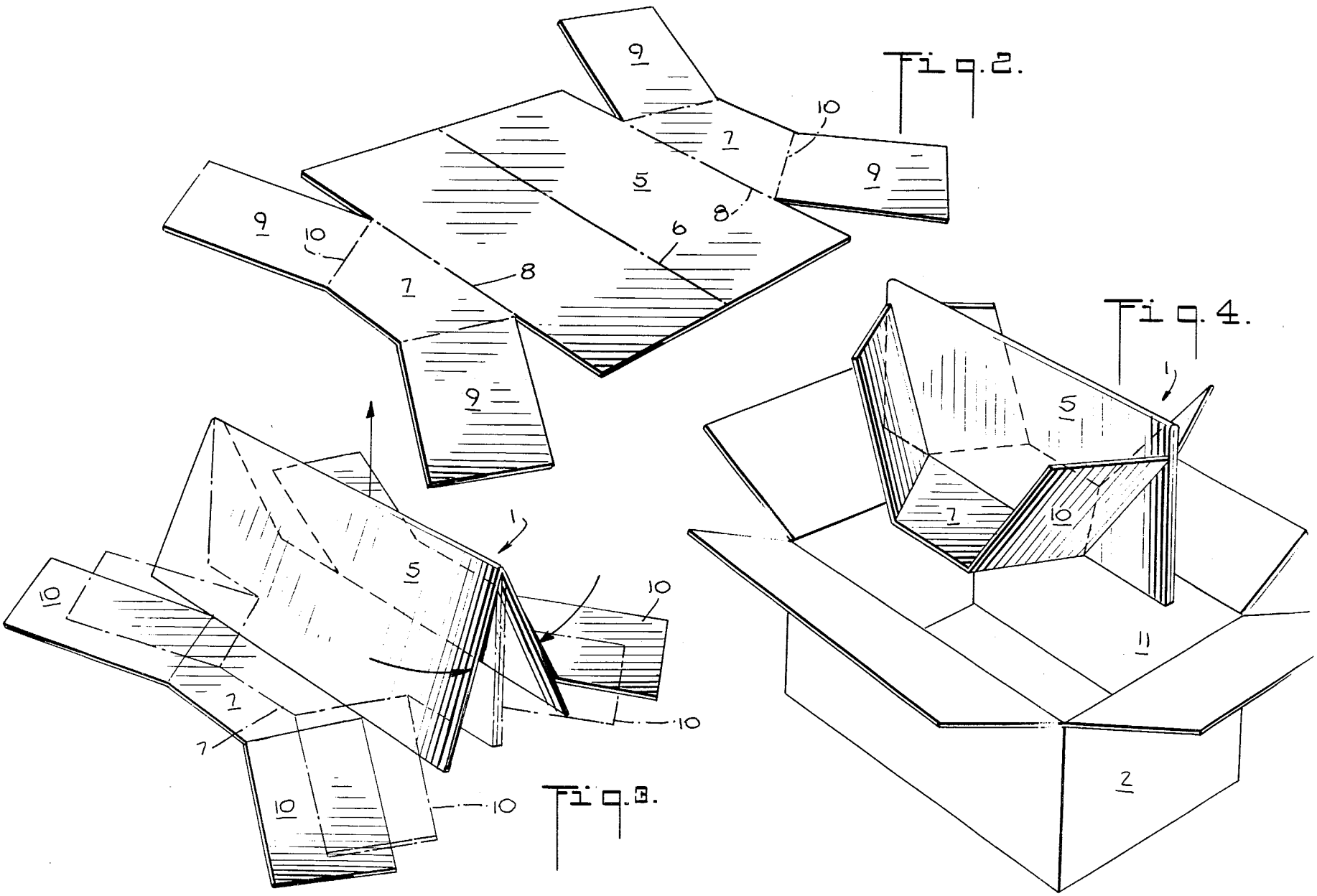
FIG. 2 is a perspective view of the improved separator as a unitary die-cut blank.
FIG. 3 illustrates the die-cut blank of FIG. 2 partially set up.
FIG. 4 illustrates a completely set up separator ready for insertion into a box.

A separator 1 in accordance with the present invention is illustrated in FIG. 1 in position in a box 2. The box 2 is packaging six cups 3 having projecting handles 4. As seen in FIG. 1, each of the cups 3 including its projecting handle 4 fits efficiently into the irregularly shaped compartments provided by the separator 1. The end compartments have a generally diamond shape in cross-section for accommodating the cup handles 4 and the center compartments having a generally trapezoidal cross-section which also accommodates the projecting handles 4 of the packaged cups 3.

It is clear from FIG. 1 that the arrangement illustrated makes efficient use of the six compartments leaving a minimum amount of unutilized space thereby providing an overall outer box 2 of minimum volume.

The separator 1 of FIG. 1 is set up from a unitary die-cut Blank as illustrated in FIG. 2. The separator blank includes a generally rectangular center panel 5 with a center score or crease 6 and with trapezoidal side flaps 7 articulated at opposite edges of the central portion 5 by scores or creases 8. Additional generally rectangular end flaps 9 are articulated at the slanted sides of the trapezoidal side flaps 7 by creases or scores 10.

FIG. 3 illustrates the first step in setting up the separator 1 in which the central panel 5 is folded along the midline 6 with angular positions illustrated successively in solid and in dash-dot lines. As panel 5 is set up to its final folded position with abutting sections, the side flaps 7 are folded to a position at right angles to the folded central panel 5 in the position shown in FIGS. 3 and 4. The end flaps 9 are next folded upwardly to a generally upright position as seen in FIG. 4.

The partially set up separator 1 is now inserted into the box 2 in the manner illustrated in FIGS. 4, 5 and 6. As the separator 1 moves downwardly into the box 2, the box side walls 11 engage and raise the end flaps 9 to their generally vertical position as seen in solid lines in FIGS. 5 and 6. This is also the position illustrated in FIG. 1 where the central panel 5, side flaps 7, and the end flaps 9 have been moved by the folding operation and the carton insertion operation to their final position.

In packing the box 2 with articles, such as the cups 3 as illustrated, the two cups 3 in the center cells are packed first to insure that the side panels 7 are pushed downwardly against the box 2 bottom and so that this motion completes the setting up of the end panels 9 to the final position illustrated in FIGS. 1 and 6. The center cells 12 with the trapezoidal cross-section illustrated permit the cup handles 4 to fill the pointed or angular end portions of these cells and the cups 3 in the end cells 13 have their handles 4 conveniently positioned in the angular corner space provided in the generally diamond-shaped end cells 13.

The above described separator 1 in shape and erected position permits the use of economical low grade sheet material for the separator 1 as a result of the compact separator design and the inherent shape retaining capability of the separator 1. The separator 1 may be formed from a blank of corrugated fiberboard, solid fiber, plastic sheeting, or similar materials.

While the box 2 is particularly efficient for use with irregular objects, such as the cups 3 discussed above, the packaged articles need not be irregular in order to realize cost savings resulting from the compact effective design, the use of an inexpensive sheet material, and the simplified separator setting-up operation.

The blank 14 illustrated in FIG. 7 is generally similar to the blank of FIG. 1, however, it illustrates a further material savings obtained by the trimmed corners 15 which reduce the overall size of the sheet required in forming the separator blank 14.

FIG. 8 illustrates two separators 16 positioned side by side for a larger box 17 with a rectangular pad 18 positioned between the adjacent separators 16. These separators 16 are set up in the same manner with the vertical pad 18 being positioned between them and acting to retain the end panels 19 in their generally upright position as illustrated in FIGS. 8 and 9.

FIG. 9 is a plan view of two separators 16 positioned with a dividing pad 18 in a box 17 packaging twelve articles 20.

The design of the separators is particularly adapted for a hand operated packing operation, however, the simplified setting up is equally well adapted for a machine packaging operation.

It will be seen that an improved separator has been provided for use in packaging both regular and irregular articles. In particular, a compact, easily set-up separator is provided which may be effectively formed from a single die-cut blank of relative inexpensive sheet materials. Additionally, the separators adapt themselves for providing overall boxes or cartons of minimal volume for the particular articles being packaged. This advantage is particularly effective in the case of irregular articles for the reasons already described above.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. A separator for dividing a rectangular box into two rows of irregularly shaped compartments comprising a unitary sheet cut to form a folded double thickness central panel, single thickness side panels hingedly connected to each of two opposite sides of said central panel, a single thickness end panel hingedly connected to both of the opposite free sides of each of said side panels, said central panel being generally rectangular and having a center fold line of weakness parallel to its said opposite sides, said side panels being generally trapezoidal with the longer side being the hinged side, and said end panels being generally rectangular.

2. The separator as claimed in claim 1 in which the free corners of said end panels are cut off.

3. The separator as claimed in claim 1 in which said sheet is corrugated board.

4. The separator as claimed in claim 1 in which said sheet is fiberboard.

5. The separator as claimed in claim 1 in which said sheet is plastic sheeting.

6. A package comprising the combination of a box with rectangular bottom and side walls, a separator positioned in said box dividing the box into two rows of irregularly shaped compartment said separator comprising a unitary sheet cut to form a folded double thickness central panel, single thickness side panels hingedly connected to each of two opposite sides of said central panel, overlying the box bottom, a single thickness end panel hingedly connected to both of the opposite free sides of each of said side panels extending vertically upwardly from the box bottom, said central panel being generally rectangular and being folded on a center fold line of weakness parallel to its said opposite sides and to the box bottom and a pair of opposed side walls, said side panels being generally trapezoidal with the longer side being the hinged side, and said end panels being generally rectangular.

7. The package as claimed in claim 6 which further comprises articles of irregular cross-section positioned in said compartments.

8. The package as claimed in claim 6 having two opposite compartments of trapezoidal cross-section and two opposite compartments in each end of generally diamond shaped cross-section.

9. A package comprising the combination of a box with rectangular bottom and side walls, a plurality of separators positioned in said box dividing the box into two rows of irregularly shaped compartments, said separator comprising a unitary sheet cut to form a folded double thickness central panel, single thickness side panels hingedly connected to each of two opposite sides of said central panel overlying the box bottom, a single thickness end panel hingedly connected to both of the opposite free sides of each of said side panels extending vertically upwardly from the box bottom, said central panel being generally rectangular and being folded on a center fold line of weakness parallel to its said opposite sides and the box bottom and a pair of opposed side walls, said side panels being generally trapezoidal with the longer side being the hinged side, said end panels being generally rectangular, and a vertical pad positioned between adjacent separators engaging vertical edges of said end panels.

10. The package as claimed in claim 9 which further comprises articles of irregular cross-section positioned in said compartments.

* * * * *